United States Patent [19]

York

[11] 4,415,430

[45] Nov. 15, 1983

[54] TWO-STAGE CENTRIFUGAL DEDUSTING PROCESS

[75] Inventor: Earl D. York, Engelwood, Colo.

[73] Assignee: Standard Oil Company (Indiana), Chicago, Ill.

[21] Appl. No.: 285,454

[22] Filed: Jul. 21, 1981

[51] Int. Cl.[3] ..... C10G 1/00; C10G 31/10

[52] U.S. Cl. ..... 208/8 R; 208/11 R; 210/806

[58] Field of Search ..... 210/760, 772, 774, 787, 210/806, 512.1; 208/11 R, 8 R

[56] References Cited

U.S. PATENT DOCUMENTS

| | | | |
|---|---|---|---|
| 1,703,192 | 2/1929 | Hampton | 208/11 R |
| 1,778,515 | 10/1930 | Hampton | 208/11 R |
| 2,524,859 | 10/1950 | Van Dongen | 208/45 |
| 3,692,668 | 9/1972 | McCoy et al. | 208/13 X |
| 3,819,053 | 6/1974 | Milotich | 210/512.1 X |
| 3,890,229 | 6/1975 | Eder | 210/768 |
| 3,929,625 | 12/1975 | Lucas | 208/11 R X |
| 3,951,771 | 7/1975 | Burger | 204/185 |
| 4,017,390 | 4/1977 | Vicard | 210/806 |
| 4,040,958 | 1/1976 | Rammler | 210/806 |
| 4,199,432 | 4/1980 | Tamm et al. | 208/11 R X |

*Primary Examiner*—Curtis R. Davis
*Assistant Examiner*—Glenn A. Caldarola
*Attorney, Agent, or Firm*—Thomas W. Tolpin; William T. McClain; William H. Magidson

[57] ABSTRACT

A two-stage dedusting process is provided for dedusting heavy oil derived from solid hydrocarbon-containing material, such as oil shale, coal, or tar sand. In the process, heavy oil is fed to a first centrifuge where it is separated into a purified stream of heavy oil and a residual dust-enriched stream. The residual dust-enriched stream is fed to a second centrifuge where it is separated into a second purified stream of heavy oil and an even more highly concentrated, dust-enriched, second residual stream. Light oil derived from the solid hydrocarbon-containing material can be injected into the centrifuges to flush out the sticky dust-enriched residual streams. The concentrated, dust-enriched, second residual stream can be dried and combusted for use as solid heat carrier material in the retort.

36 Claims, 2 Drawing Figures

TWO-STAGE CENTRIFUGAL DEDUSTING PROCESS

BACKGROUND OF THE INVENTION

This invention relates to synthetic fuels, and more particularly, to a process for dedusting heavy oil laden with dust derived from solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" which decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah and Wyoming. The remainder is contained in the leaner Devonian-Mississippian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in above-ground vessels or in situ retorts underground. In principle, the retorting of shale and other hydrocarbon-containing materials, such as coal and tar sand, comprise heating the solid hydrocarbon-containing material to an elevated temperature and recovering the vapors and liberated effluent. However, as medium grade oil shale yields approximately 25 gallons of oil per ton of shale, the expense of materials handling is critical to the economic feasibility of a commercial operation.

In surface retorting, oil shale is mined from the ground, brought to the surface, crushed and placed in vessels where it is contacted with a hot heat transfer carrier, such as ceramic or metal balls, hot spent shale or sand for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the reactor and recycled as heat carrier material or discarded. The combustion gases are dedusted in a cyclone or electrostatic precipitator.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), gas combustion and fluid bed. Process heat requirements for surface retorting processes may be supplied either directly or indirectly.

During fluid bed, moving bed and other types of surface retorting, decrepitation of oil shale occurs creating a popcorning effect in which particles of oil shale collide with each other and impinge against the walls of the retort forming substantial quantities of minute entrained particulates of shale dust. The use of hot spent shale or sand as heat carrier material aggravates the dust problem. Rapid retorting is desirable to minimize thermal cracking of valuable condensable hydrocarbons, but increases the rate of decrepitation and amount of dust. Shale dust is also emitted and carried away with the effluent product stream during modified in situ retorting as a flame front passes through a fixed bed of rubblized shale, as well as in fixed bed surface retorting, but dust emission is not as aggravated as in other types of surface retorting.

Shale dust ranges in size from less than 1 micron to 1000 microns and is entrained and carried away with the effluent product stream. Because shale dust is so small, it cannot be effectively removed to commercially acceptable levels by conventional dedusting equipment.

The retorting, carbonization or gasification of coal, peat and lignite and the retorting or extraction of tar sand and gilsonite create similar dust problems.

After retorting, the effluent product stream of liberated hydrocarbons and entrained dust is withdrawn from the retort through overhead lines and subsequently conveyed to a separator, such as a single or multiple stage distillation column, quench tower, scrubbing cooler or condenser, where it is separated into fractions of light gases, light oils, middle oils and heavy oils with the bottom heavy oil fraction containing essentially all of the dust. As much as 50% by weight of the bottom heavy oil fraction consists of dust.

It is very desirable to upgrade the bottom heavy oil into more marketable products, such as light oils and middle oils, but because the heavy oil fraction is laden with dust, it is very viscous and cannot be pipelined. Dust laden heavy oil plugs up hydrotreaters and catalytic crackers, gums up valves, heat exchangers, outlet orifices, pumps and distillation towers, builds up insulative layers on heat exchange surfaces reducing their efficiency and fouls up other equipment. Furthermore, the dusty heavy oil corrodes turbine blades and creates emission problems. If used as a lubricant, dusty heavy oil is about as useful as sand. Moreover, the high nitrogen content in the dusty heavy oil cannot be refined with conventional equipment.

In an effort to solve this dust problem, electrostatic precipitators have been used as well as cyclones located both inside and outside the retort. Electrostatic precipitators and cyclones, however, must be operated at very high temperatures and the product stream must be maintained at or above the highest temperature attained during the retorting process to prevent any condensation and accumulation of dust on processing equipment. Maintaining the effluent steam at high temperatures is not only expensive from an energy standpoint, but it allows detrimental side reactions, such as cracking, coking and polymerization of the effluent product stream, which tends to decrease the yield and quality of condensable hydrocarbons.

Over the years various processes and equipment have been suggested to decrease the dust concentration in the heavy oil fraction and/or upgrade the heavy oil into more marketable light oils and medium oils. Such prior art dedusting processes and equipment have included the use of cyclones, electrostatic precipitators, pebble beds, scrubbers, filters, electric treaters, spiral tubes, ebullated bed catalytic hydrotreaters, desalters, autoclave settling zones, sedimentation, gravity settling, percolation, hydrocloning, magnetic separation, electrical precipitation, stripping and binding, as well as the use of diluents, solvents and chemical additives before centrifuging. Typifying those prior art processes and equipment and related processes and equipment are those found in U.S. Pat. Nos. 2,235,639; 2,717,865; 2,719,114; 2,723,951; 2,793,104; 2,879,224; 2,899,736; 2,904,499; 2,911,349; 2,952,620; 2,968,603; 2,982,701; 3,008,894; 3,034,979; 3,058,903; 3,252,886; 3,255,104; 3,468,789; 3,560,369; 3,684,699; 3,703,442; 3,784,462; 3,799,855; 3,808,120; 3,900,389; 3,901,791; 3,929,625; 3,974,073; 3,990,885; 4,028,222; 4,040,958; 4,049,540; 4,057,490; 4,069,133; 4,080,285; 4,088,567; 4,105,536; 4,151,073; 4,159,949; 4,162,965; 4,166,441; 4,182,672; 4,199,432; 4,220,522 and 4,246,093 as well as in the articles by Rammler, R. W., *The Retorting of Coal, Oil Shale and Tar Sand By Means of Circulated Fine-Grained Heat Carriers as a Preliminary Stage in the Production of Synthetic Crude Oil*, Volume 65, Number 4, Quarterly of the Colorado School of Mines, pages 141–167 (October 1970) and Schmalfeld, I. P., *The Use of The Lurgi/Ruhrgas Process For The Distillation of Oil Shale*, Volume 70, Number 3, Quarterly of the Colorado School of Mines, pages 129–145 (July 1975). These prior art processes and equipment have not been successful in decreasing the dust concentration in the heavy oil fraction to commercially acceptable levels.

It is therefore desirable to provide an improved process, which overcomes most, if not all, of the preceding problems.

SUMMARY OF THE INVENTION

An improved process is provided for dedusting at least 80% to 90% of dust laden heavy oil derived from solid hydrocarbon-containing material such as oil shale, coal or tar sand, into purified streams of heavy oil containing less than 0.3% to 1% dust. Advantageously, the purified heavy oil can be safely pipelined through valves, outlet orifices, pumps, heat exchangers and distillation columns and can be refined in hydrotreaters and catalytic crackers.

The dust laden hevy oil can be derived from in situ retorting or surface retorting, such as in a fluid bed or screw conveyor retort where hot spent hydrocarbon-containing material is used as solid heat carrier material to retort raw oil shale, coal or tar sand, and in which the retorted effluent product stream is separated in a single or multiple stage separator, such as a quench tower, scrubber or distillation column, sometimes referred to as a "fractionating column" or "fractionator," into a dust laden heavy oil fraction containing as much as 25% to 50% by weight dust.

The term "dust" as used in this application means particulates derived from solid hydrocarbon-containing material and ranging in size from less than one micron to 1000 microns. The particulates can include retorted and raw, unretorted hydrocarbon-containing material, as well as spent hydrocarbon-containing material or sand if the latter are used as solid heat carrier material during retorting.

Dust derived from the retorting of oil shale consists primarily of calcium, magnesium oxides, carbonates, silicates and silicas. Dust derived from the retorting or extraction of tar sand consists primarily of silicates, silicas and carbonates. Dust derived from the retorting, carbonization or gasification of coal consists primarily of char and ash.

As used throughout this application, the term "retorted" hydrocarbon-containing material or "retorted" shale refers to hydrocarbon-containing material or oil shale, respectively, which has been retorted to liberate hydrocarbons leaving an organic material containing carbon residue.

The term "spent" hydrocarbon-containing material or "spent" shale as used herein means retorted hydrocarbon-containing material or shale, respectively, from which all of the carbon residue has been removed by combustion.

The terms "normally liquid," "normally gaseous," "condensable," "condensed," or "noncondensable," are relative to the condition of the subject material at a temperature of 77° F. (25° C.) at atmospheric pressure.

In the novel process, dust laden heavy oil is heated, preferably to a viscosity of less than 2 to 5 centistokes, and fed into a first centrifuge where it is separated into a dedusted first stream of heavy oil having a substantially lower concentration of dust than the influent dust laden heavy oil and a first dust laden residual stream having a higher concentration of dust than the influent dust laden heavy oil. The first residual stream is fed, preferably at a viscosity of less than 2 to 5 centistokes, to a second centrifuge where it is separated into a dedusted second stream of heavy oil having a substantially lower concentration of dust than the influent dust laden heavy oil and a second dust laden residual stream having a higher concentration of dust than the first residual stream. Preferably, the influent dust laden streams are each mixed in a separate vessel and some of the effluent mixture recycled to the vessels to enhance uniform suspension of dust before the streams are centrifuged. A flushing agent, such as light oil derived from the oil shale, coal or tar sand, can be injected into the centrifuges to wash out the dust laden residual streams.

Desirably, the dusty, second residual stream from the second centrifuge can be dried in a heater to drive off light oil vapors leaving a third dust laden residual stream having an even higher dust concentration. The powdery dust-enriched, third residual stream can be fed to a lift pipe where any remaining heavy oil is combusted leaving a spent stream that can be conveyed to the retort to provide a portion of the solid heat carrier material.

A more detailed explanation of the invention is provided in the following description and appended claims taken in conjunction with the accompanying drawings.

DETAILED DESCRIPTION OF THE PREFERRED EMBODIMENT

Figures 1, 2:
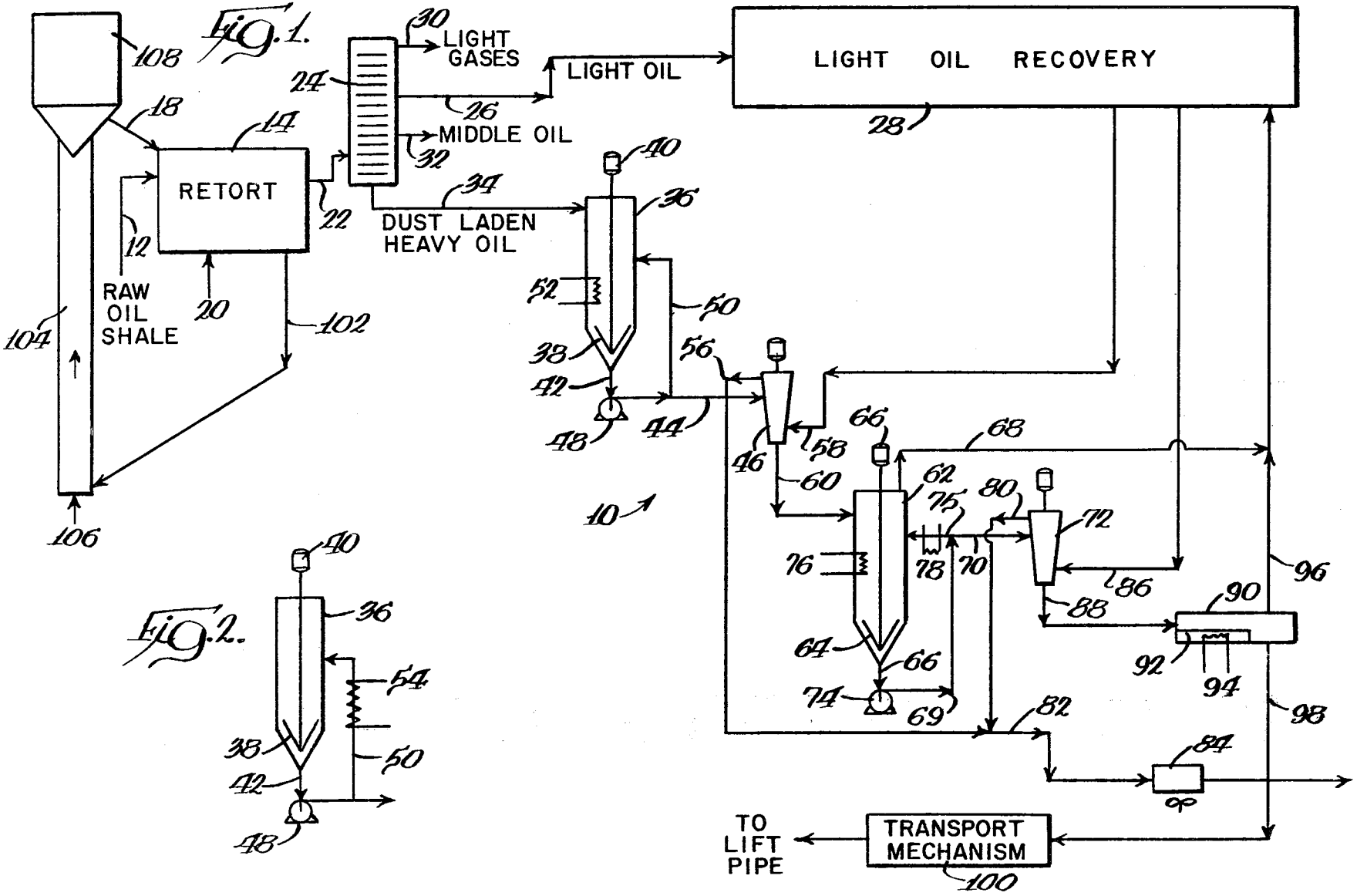
FIG. 1 is a schematic flow diagram of a two-stage dedusting process in accordance with principles of the present invention.
FIG. 2 is an alternative embodiment of part of the two-stage dedusting process.

Referring now to FIG. 1, a two-stage centrifugal dedusting process and system 10 is provided to dedust dust laden heavy oil derived from solid hydrocarbon-containing material, such as oil shale, coal, tar sand, uintaite (gilsonite), lignite and peat, into purified streams of heavy oil for use in making synthetic fuels. While the process of the present invention is described hereinafter with particular reference to the processing of oil shale, it will be apparent that the process can also be used in connection with the processing of other hydrocarbon-containing materials, such as coal, tar sand, uintaite (gilsonite), lignite, peat, etc.

In process and system 10, raw fresh oil shale, which preferably contains an oil yield of at least 15 gallons per ton of shale particles, is crushed and sized to a maximum fluidizable size of 10 mm and fed through raw shale inlet line 12 at a temperature from ambient temperature to 600° F. into a fluid bed retort 14, also referred to as a "fluidized bed retort." The fresh oil shale can be crushed by conventional crushing equipment, such as an impact crusher, jaw crusher, gyratory crusher or roll crusher and screened with conventional screening equipment, such as a shaker screen or a vibrating screen.

Spent oil shale and spent third dust laden residual stream, which together provide solid heat carrier material, are fed through heat carrier line 18 at a temperature from 1000° F. to 1400° F., preferably from 1200° F. to 1300° F., into retort 14 to mix with, heat and retort raw oil shale in retort 14. A fluidizing lift gas such as light hydrocarbon gases or other gases that do not contain an amount of molecular oxygen sufficient to support combustion, is injected into the bottom of retort 14 through a gas injector 20 to fluidize, entrain and enhance mixing of the raw oil shale and solid heat carrier material in retort 14.

Retort 14 operates at a retorting temperature from 850° F. to 1000° F., and preferably from 900° F. to about 960° F. at atmosphere pressure.

During retorting, hydrocarbons are liberated from the raw oil shale as a gas, vapor, mist or liquid droplets and most likely a mixture thereof along with entrained particulates of oil shale dust ranging in size from less than one micron to 1000 microns.

The mixture of liberated hydrocarbons and entrained particulates are discharged from retort 14 through outlet line 22 and conveyed to a separator 24, such as a quench tower or fractionating column. The effluent mixture can be partially dedusted in a cyclone (not shown) before being fed into separator 24. The effluent product stream of liberated hydrocarbons and entrained particulates are separated in quench tower or fractionating column 24 into fractions of light gases, light shale oil, middle shale oil and heavy shale oil. Light gases and middle shale oil are withdrawn from separator 24 through light gas line 30 and middle oil line 32, respectively. The light oil fraction is discharged from separator 24 through light oil line 26 and conveyed to light oil processing and recovering equipment 28. Heavy shale oil has a boiling point over 600° F. to 800° F. Middle shale oil has a boiling point over 400° F. to 500° F. and light shale oil has a boiling point over 100° F.

The solids bottom heavy oil fraction is a slurry recovered at the bottom of separator 24 that contains from 15% to 35% by weight of the effluent product stream. The slurry, which is also referred to as "dust laden heavy oil" or "dusty oil," consists essentially of normally liquid heavy shale oil and from 1% to 50% by weight and preferably at least 25% by weight entrained particulates of oil shale dust. The temperature in separator 24 can be varied from 500° F. to 800° F. and preferably to a maximum temperature of 600° F. at atmospheric pressure to assure that essentially all the oil shale particulates gravitate to and are entrained in the bottoms fraction.

The dust laden heavy shale oil is discharged from the bottom of separator 24 through heavy oil discharge line 34 and fed to a first insulated holding vessel 36, where it is mixed by mixer 38 driven by motor 40 to enhance a uniform suspension of shale dust in the heavy oil. The mixed dusty oil is discharged from the bottom of vessel 36 through first vessel discharge line 42 and pumped through first centrifuge inlet line 44 into first centrifuge 46 by pump 48. A portion of the mixed dusty oil is pumped back and recirculated into vessel 36 through first recirculation line 50 to further enhance a uniform suspension of the shale dust in the heavy oil.

In order to compensate for any heat that may be lost from the dust laden heavy oil in heavy oil discharge line 34 or vessel 36, vessel 36 is equipped with a heater 52 in the form of a heating coil, jacket or steam-fed heat exchanger, to heat the dust laden heavy oil to a temperature from 500° F. to 600° F. at atmospheric pressure to assure that the dusty heavy oil fed to first centrifuge 46 has a viscosity of less than 5 centistokes and preferably less then 2 centistokes. Alternatively, in lieu of heater 52, the recirculated dusty oil can be heated by a steam fed heat exchanger 54 as shown in FIG. 2.

The dusty oil is centrifuged in first centrifuge 46 from 2,000 rpm to 4,000 rpm and preferably at 2,500 rpm and at a pressure to minimize vaporization of the oil. Centrifuge 46 separates the dusty oil into a dedusted first purified stream and a first dust laden residual stream. The dedusted stream consists of normally liquid heavy shale oil containing less than 1%, and preferably less than 0.3%, by weight shale dust. The dedusted stream of heavy oil is a clear liquid or clarified heavy shale oil, also referred to as a "centrate," and is withdrawn from the upper portion of centrifuge 46 through first centrate line 56.

The residual stream from centrifuge 46 consists of from 25% to 40% and preferably 30% by weight of normally liquid heavy shale oil and from 60% to 75% and preferably 70% by weight shale dust. The residual stream or solids stream is a centrifugation sludge, cake or residue, also referred to as a sediment.

Light shale oil from light oil recovery equipment 28 can be injected into centrifuge 46 through light oil injection line 58 to flush and wash out the sticky residual stream from the bottom of centrifuge 46 into a first centrifuge discharge line 60.

The solids stream flushed and admixed with the light oil is fed to a second insulated holding vessel 62 at a temperature from 500° F. to 600° F., where it is mixed by mixer 64 driven by motor 66 to enhance suspension of the shale dust in the heavy oil. Light oil vapors emitted from the mixture are withdrawn through overhead line 68 and recycled to the light oil recovery equipment for further use in the system.

The residue containing heavy shale oil diluted with light shale oil is discharged from the bottom of second vessel 62 through second vessel discharge line 66 and is pumped through second centrifuge inlet lines 69 and 70 into second centrifuge 72 by pump 74. A portion of the residue containing heavy shale oil diluted with light shale oil is recirculated and pumped back to second vessel 62 through second recirculation line 75 to further enhance suspension of the shale dust in the heavy oil. If there is appreciable loss of heat in the solid stream flowing through the first centrifuge discharge line 60 and second vessel 62, the mixture can be heated from 100° F. to 300° F., and preferably 250° F. by a heating coil or steam fed heat exchanger 76 in vessel 62 or, alternatively, by passing the residue containing heavy shale oil diluted with light shale oil through a steam fed heat exchanger 78, so as to assure that the residue containing heavy shale oil diluted with light shale oil is fed into second centrifuge 72 at a viscosity of less than 5 centistokes and preferably less than 2 centistokes.

The residue containing heavy shale oil diluted with light shale oil is centrifuged in second centrifuge 72 from 2,000 rpm to 4,000 rpm and preferably at 2,500 rpm and at a pressure to minimize vaporization of the oil. Centrifuge 72 separates the residue containing heavy oil diluted with light shale oil into a dedusted second purified stream and a second dust laden residual stream. The dedusted second stream consists of normally liquid heavy shale oil admixed with light shale oil and contains less than 1% and preferably less than 0.3% by weight shale dust. The dedusted second stream of heavy oil is a clear liquid or clarified shale oil, sometimes referred to as the second "centrate," and is withdrawn from the upper portion of second centrifuge 72 through second centrate line 80. The withdrawn second centrate is fed into first centrate line 82, where it is mixed with the first centrate. The mixed purified streams are fed to air cooler 84, where they are cooled to an environmentally suitable temperature for storage.

The residual stream (second residual stream) from centrifuge 72 consists of 25% to 40% and preferably 30% by weight of an admixture of normally liquid heavy shale oil and light oil and from 60% to 75% and preferably 70% by weight shale dust. The second residual stream or second solids stream is a centrifugation sludge, cake or residue which is also referred to as the second "sediment." Light shale oil from light oil recovery equipment 28 can be injected into second centrifuge 72 through second centrifuge injector 86 to flush and wash out the sticky second solids stream from the bottom of second centrifuge 72 through second centrifuge discharge line 88.

The second solids stream flushed and mixed with light oil, is fed into a heater or dryer 90, preferably an indirect dryer with a longitudinal strip 92 of metal or other heat conductive material therein to separate the heating coil 94 from the second solids stream and light oil. Dryer 90 heats the second solids stream and light oil to 500° F. to vaporize and drive off the light oil through overhead light oil line 96 leaving a powdery, third dust laden residual stream. The vaporized light oil is recirculated through overhead line 96 to light oil recovery equipment 28 for further use in the system. The third dust laden residual stream or third solids stream consists of from 10% to 20% by weight normally liquid heavy shale oil and from 80% to 90% by weight shale dust.

The third solids stream is removed from the bottom of dryer 90 through dryer discharge line 98 where it is transported by a transport mechanism 100, such as a pneumatic conveyor, screw conveyor, solids vibrating conveyor or other conveying means well known in the art to the bottom of a vertical combustor lift pipe 104 where it is mixed with retorted shale and spent shale discharged from the bottom of retort 14 through solids discharge line 102. Air is injected into the bottom of lift pipe 104 through air injector nozzle 106 to fluidize, entrain, propel and convey the third solids stream, oil shale and spent shale upwardly through the lift pipe into a collection and separation bin 108, also referred to as a "collector." Heavy shale oil contained in the powdery third solids stream and carbon residue contained in the retorted shale is combusted in lift pipe 104 leaving a hot, combusted (spent) third solids stream and shale, respectively for use as solid heat carrier material. The heat carrier material is discharged from the bottom of collector 108 through heat carrier line 18 into retort 14.

While the retort shown in the preferred embodiment is a fluid bed retort, other retorts can be used such as a screw conveyor retort followed by a surge bin or a rotating pyrolysis drum followed by an accumulator. Metal or ceramic balls can also be used as a solid heat carrier material with the lift pipe serving as a ball heater. Sand can also be used as the heat carrier material. Furthermore, while the illustrated centrifuges are vertical centrifuges, horizontal centrifuges and multiple-stage centrifuges can also be used.

Among the many advantages of the two-stage centrifugal dedusting process and system are:

1. Improved product yield.
2. Lower product viscosity.
3. Better dedusting of the bottom heavy oil fraction.
4. Ability to pipeline the dedusted heavy shale oil through valves, outlet orifices, heat exchanges, pumps and distillation towers and refine the dedusted heavy oil in hydrotreaters and catalytic crackers.

Although embodiments of this invention have been shown and described, it is to be understood that various modifications and substitutions, as well as rearrangement and combination of process steps, can be made by those skilled in the art without departing from the novel spirit and scope of this invention.

What is claimed is:

1. A process for dedusting particulate laden heavy oil derived from solid hydrocarbon-containing material, comprising the steps of:

introducing solid hydrocarbon-containing material into a retort;

introducing solid heat carrier material into said retort;

retorting said solid hydrocarbon-containing material by contacting said solid hydrocarbon-containing material with said solid heat carrier material at a retorting temperature to liberate a mixture of hydrocarbons and entrained particulates of dust ranging in size from less than one micron to 1000 microns derived from said solid hydrocarbon-containing material;

separating a heavy oil fraction laden with said particulates of dust from said mixture;

heating said heavy oil fraction laden with said particulates of dust to a viscosity of less than 5 centistokes;

feeding said heated fraction to a first centrifuge;

centrifuging said heated fraction in said first centrifuge into a dedusted first stream of normally liquid heavy oil containing less than 1% by weight of said particulates and a first particulate laden residual stream containing a substantially higher concentration of said particulates then said oil fraction;

injecting light oil derived from said solid hydrocarbon-containing material into said first centrifuge to enhance removal of said first particulate laden residual stream from said first centrifuge;

feeding said first particulate laden residual stream injected with said light oil at a viscosity of less than 5 centistokes to a second centrifuge;

centrifuging said first particulate laden residual stream injected with said light oil in said second centrifuge into a dedusted second stream of normally liquid oil including light oil containing less than 1% by weight of said particulates and a second particulate laden residual stream containing a substantially higher concentration of said particulates than said first particulate laden residual stream;

heating said second particulate laden residual stream to vaporize said light oil and form a third particulate dust laden residual stream containing a higher concentration of said particulates than said second particulate dust laden residual stream;

feeding said third particulate dust laden stream to a lift pipe;

injecting air into said lift pipe to combust heavy oil contained in said third particulate dust laden stream and fluidize, entrain and propel said third particulate laden residual stream to a separation bin; and conveying said combusted third particulate laden residual stream to said retort to provide at least a portion of said solid heat carrier material.

2. A process in accordance with claim 1 wherein said hydrocarbon-containing material is selected from the group consisting of oil shale, tar sand, coal, lignite, peat and uintaite.

3. A process in accordance with claim 1 further including:

removing retorted hydrocarbon-containing material from said retort;

feeding said retorted hydrocarbon-containing material into said lift pipe;

combusting, fluidizing, entraining and propelling said retorted hydrocarbon-containing material along with said third particulate laden residual stream upwardly in said lift pipe to said separation bin; and conveying said combusted, retorted, hydrocarbon-containing material along with said combusted, third particulate laden residual stream to said retort.

4. A process in accordance with claim 1 further including mixing said heavy oil fraction in a first vessel before said heavy oil fraction is fed to said first centrifuge.

5. A process in accordance with claim 4 wherein said heavy oil fraction is heated in said first vessel.

6. A process in accordance with claim 4 wherein said mixed heavy oil fraction is discharged from said first vessel and a portion of said discharged, heavy oil fraction is recirculated back to said first vessel.

7. A process in accordance with claim 6 wherein said discharged heavy oil fraction is heated before being recirculated back to said first vessel.

8. A process in accordance with claim 1 wherein said first particulate laden residual stream injected with said light oil is fed to a second vessel before being fed to said second centrifuge.

9. A process in accordance with claim 8 wherein said first particulate laden residual stream injected with light oil is mixed in said second vessel.

10. A process in accordance with claim 8 wherein said first particulate laden residual stream injected with light oil is heated in said second vessel.

11. A process in accordance with claim 8 wherein some of said light oil is vaporized in and removed from said second vessel.

12. A process in accordance with claim 8 wherein said first particulate laden residual stream is discharged from said second vessel and a portion of said discharged first particulate laden residual stream is recirculated back to said second vessel.

13. A process in accordance with claim 12 wherein said discharged first particulate laden residual stream is heated before being recirculated to said second vessel.

14. A process in accordance with claim 1 wherein said dedusted first stream is mixed with said dedusted second stream.

15. A process in accordance with claim 14 wherein said mixed dedusted streams are cooled.

16. A process in accordance with claim 1 wherein said heavy oil fraction is heated to a viscosity less than 2 centistokes before being fed to said first centrifuge.

17. A process in accordance with claim 1 wherein said first particulate laden residual stream injected with said light oil is fed at a viscosity of less than 2 centistokes to said second centrifuge.

18. A process in accordance with claim 1 wherein said dedusted streams each contain less than 0.3% by weight of said particulates.

19. A process for dedusting heavy shale oil, comprising the steps of:

mixing dust laden heavy shale oil consisting of normally liquid heavy shale oil having a boiling point over 600° F. and from 25% to 50% by weight of entrained particulates of shale dust ranging in size from less than 1 micron to 1000 microns, in a first vessel to enhance uniform suspension of said shale dust;

pumping a portion of said mixed dust laden heavy shale oil back to said first vessel to further enhance uniform suspension of said shale dust;

heating said dust laden heavy shale oil to a temperature from 500° F. to 600° F. at atmospheric pressure to decrease the viscosity of said dust laden heavy shale oil to less than 5 centistokes;

pumping said heated dust laden heavy shale oil to a first centrifuge;

centrifuging said heated dust laden heavy shale oil in said first centrifuge into a dedusted first stream consisting of normally liquid heavy shale oil and less than 1% by weight of said shale dust and a first dust laden residual stream consisting of from 25% to 40% by weight of normally liquid heavy shale oil and from 60% to 75% by weight of said shale dust;

injecting light shale oil into said first centrifuge to flush said first dust laden residual stream out of said first centrifuge;

feeding said first dust laden residual stream to a second vessel;

mixing said first dust laden residual stream in said second vessel to enhance uniform suspension of said shale dust in said first dust laden residual stream;

pumping a portion of said mixed residual stream back to said second vessel to further enhance uniform suspension of said shale dust;

maintaining said mixed residual stream at a viscosity of less than 5 centistokes;

pumping said mixed residual stream to a second centrifuge;

centrifuging said residual stream in said second centrifuge into a dedusted second stream of normally liquid heavy shale oil diluted with light shale oil and less than 1% by weight of said shale dust and a second dust laden residual stream consisting of from 25% to 40% by weight of normally liquid heavy shale oil diluted with light shale oil and 60% to 75% by weight of said shale dust;

feeding said second dust laden residual stream to a dryer;

heating said second dust laden residual stream in said dryer to at least about 500° F. to vaporize said light shale oil and form a third dust laden residual stream consisting of from 10% to 20% by weight normally liquid heavy shale oil and from 80% to 90% by weight of said shale dust;

removing said light shale oil vapors from said dryer;

conveying said third dust laden residual stream to a lift pipe;

combusting said normally liquid heavy shale oil in said third particulate laden residual stream in said lift pipe leaving a spent stream;

conveying said spent stream to a retort; and retorting raw oil shale in said retort by mixing solid heat carrier material containing said spent stream with said raw oil shale in said retort.

20. A process in accordance with claim 19 wherein said first dust laden residual stream consists of 30% by weight of normally liquid heavy shale oil and 70% by weight of said shale dust.

21. A process in accordance with claim 19 wherein said second dust laden residual stream consists of 30% by weight of said normally liquid heavy shale oil diluted with light shale oil and 70% by weight of said shale dust.

22. A process in accordance with claim 19 wherein said shale oil is heated to a temperature from 100° F. to 300° F. before being pumped to said second centrifuge.

23. A process in accordance with claim 19 wherein said shale oil is heated to about 250° F. before being pumped to said second centrifuge.

24. A process in accordance with claim 19 wherein said dedusted streams contain from 80% to 95% by weight of said heavy shale oil from said dust laden heavy shale oil.

25. A process in accordance with claim 19 wherein said dedusted streams contain at least 90% by weight of said heavy shale oil from said dust laden heavy oil.

26. A process in accordance with claim 19 wherein said dedusted streams each contain less than 0.3% by weight of said shale dust.

27. A process for producing and dedusting shale oil, comprising the steps of:

introducing raw oil shale into a retort;

introducing solid heat carrier material containing spent oil shale and a spent stream into said retort at a temperature from 1000° F. to 1400° F.;

retorting said raw oil shale by mixing said raw oil shale with said solid heat carrier material in said retort at a retorting temperature from 850° F. to 1000° F. to liberate a mixture of hydrocarbons and entrained particulates of shale dust selected from the group consisting of raw oil shale, retorted oil shale and spent oil shale, said shale dust ranging in size from less than one micron to 1000 microns;

separating a light oil fraction and a 15% to 35% by weight, particulate laden heavy oil fraction consisting of normally liquid heavy shale oil having a boiling point over 600° F. and from 25% to 50% by weight of said entrained particulates of shale dust;

mixing said particulate laden heavy oil fraction in a first vessel to enhance uniform suspension of said shale dust;

pumping a portion of said mixed fraction back to said first vessel to further enhance uniform suspension of said shale dust;

heating said particulate laden heavy oil fraction to a temperature from 500° F. to 600° F. at atmospheric pressure to decrease the viscosity of said particulate laden heavy oil fraction to less than 5 centistokes;

pumping said heated fraction to a first centrifuge;

centrifuging said heating fraction in said first centrifuge into a dedusted first stream consisting of normally liquid heavy shale oil and less than 1% by weight of said shale dust and a first particulate laden residual stream consisting of from 25% to 40% by weight of normally liquid heavy shale oil and from 60% to 75% by weight of said shale dust;

injecting light shale oil derived from said light oil fraction into said first centrifuge to flush said first particulate laden residual stream out of said first centrifuge;

feeding said first particulate laden residual stream admixed with said light shale oil at a temperature from 500° F. to 600° F. to a second vessel;

vaporizing some of said light shale oil from said admixture;

mixing said admixture in said second vessel to enhance uniform suspension of said shale dust in said admixture;

removing said light shale oil vapors from said admixture in said second vessel leaving a residue consisting of normally liquid heavy shale oil diluted with normally liquid light shale oil;

pumping a portion of said residue back to said second vessel to further enhance uniform suspension of said shale dust in said admixture;

maintaining a viscosity of less than 5 centistokes in said residue;

pumping said residue to a second centrifuge;

centrifuging said residue in said second centrifuge into a dedusted second stream consisting of normally liquid heavy shale oil diluted with said light shale oil and less than 1% by weight of said shale dust and a second particulate laden residual stream consisting of from 25% to 40% by weight of normally liquid heavy shale oil diluted with said light shale oil and from 60% to 75% by weight of said shale dust;

feeding said second particulate laden residual stream to a dryer;

heating said second particulate laden residual stream in said dryer to at least about 500° F. to vaporize said light shale oil and form a third particulate laden residual stream consisting of from 10% to 20% by weight normally liquid heavy shale oil and from 80% to 90% by weight of said shale dust;

removing said light shale oil vapors from said dryer;

conveying said third particulate laden residual stream to a lift pipe;

combusting said heavy shale oil in said third particulate laden residual stream in said lift pipe to leave a spent stream; and conveying said spent stream to said retort to provide at least a portion of said solid heat carrier material.

28. A process in accordance with claim 27 wherein said retorting temperature is from 900° F. to 960° F.

29. A process in accordance with claim 27 wherein said solid heat carrier material is introduced into said retort at a temperature from 1200° F. to 1300° F.

30. A process in accordance with claim 27 wherein said first particulate laden residual stream consists of 30% by weight of normally liquid heavy shale oil and 70% by weight of said shale dust.

31. A process in accordance with claim 27 wherein said second particulate laden residual stream consists of 30% by weight of said normally liquid heavy shale oil diluted with said light shale oil and 70% by weight of said shale dust.

32. A process in accordance with claim 27 wherein said shale oil is heated to a temperature from 100° F. to 300° F. before being pumped to said second centrifuge.

33. A process in accordance with claim 27 wherein said shale oil is heated to about 250° F. before being pumped to said second centrifuge.

34. A process in accordance with claim 27 wherein from 80% to 90% by weight of said normally liquid heavy shale oil from said particulate laden heavy oil fraction is dedusted and recovered in said dedusted streams.

35. A process in accordance with claim 27 wherein at least 90% by weight of said normally liquid heavy shale oil from said particulate laden heavy oil fraction is dedusted and recovered in said dedusted streams.

36. A process in accordance with claim 35 wherein said dedusted streams each contain less than 0.3% by weight of said shale dust.

* * * * *

UNITED STATES PATENT OFFICE

CERTIFICATE OF CORRECTION

Patent No. 4,415,430 Dated November 15, 1983

Inventor(s) YORK, EARL D.

It is certified that error appears in the above-identified patent and that said Letters Patent are hereby corrected as shown below:

| Patent Column | Line | | | |
|---|---|---|---|---|
| 3 | 67 | "hevy" | should be | --heavy-- |
| 9 | 12 | "then" | should be | --than-- |

Signed and Sealed this

Fifth Day of June 1984

[SEAL]

Attest:

GERALD J. MOSSINGHOFF

Attesting Officer

Commissioner of Patents and Trademarks